US006533156B1

(12) United States Patent
Chang

(10) Patent No.: US 6,533,156 B1
(45) Date of Patent: Mar. 18, 2003

(54) PNEUMATIC NAIL GUN

(76) Inventor: We-Chou Chang, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/236,249

(22) Filed: Sep. 9, 2002

(51) Int. Cl.[7] ..... B25C 1/04
(52) U.S. Cl. ..... 227/130; 227/8
(58) Field of Search ..... 227/130, 8, 119, 227/136; 173/210, 212

(56) References Cited

U.S. PATENT DOCUMENTS 5,485,946 A * 1/1996 Jankel ..... 227/130
5,782,395 A * 7/1998 Sauer ..... 227/130
5,881,941 A * 3/1999 Lai ..... 227/130
6,059,166 A * 5/2000 Ho et al. ..... 227/130
6,296,168 B1 * 10/2001 Hung ..... 227/130
6,371,348 B1 * 4/2002 Canlas et al. ..... 227/8
6,419,141 B1 * 7/2002 Wang ..... 227/130

* cited by examiner

*Primary Examiner*—Scott A. Smith
(74) *Attorney, Agent, or Firm*—Charles E. Baxley

(57) ABSTRACT

A pneumatic nail gun includes a passage defined through the end cap and the passage communicates with a space between the cylinder in the body of the gun and an inside of the body. The cylinder has an opening which communicates with the space so that when pulling the trigger to eject a nail and then releasing the trigger, the pressurized air is supplied via the passage in the end cap and pushes the piston back to its ready-to-fire position more quickly than the conventional nail gun. The space may also be made in a form of an interior pipe so that the area of the piston can be as big as the inner diameter of the hollow body of the nail gun.

3 Claims, 12 Drawing Sheets

PNEUMATIC NAIL GUN

FIELD OF THEE INVENTION

The present invention relates to a pneumatic nail gun that has a chamber communicating with an interior of a cylinder and the air in the cylinder is pushed into the chamber when ejecting a nail. The air in the chamber pushes the piston back quickly when the trigger is released.

BACKGROUND OF THE INVENTION

A conventional pneumatic nail gun is shown in FIG. 1 and generally includes a cylinder 241 received in the body of the gun, a handle 1 with a main passage 11 connected the body, and a trigger valve 50 movably received in a space 12 of the handle 1. The cylinder 241 has a pushing member 22 movably connected to an end thereof and a spring 21 is engaged between the pushing member 22 and an end cap 2 which is fixed to the body of the gun. The pushing member 22 movably seals an end of the cylinder 241 by the spring 21. The main passage 11 communicates with a space defined between the cylinder 241 and the pushing member 22 and a hole 13 defined through a wall of the handle 1 so as to communicate the main passage 11 and the space 12. A tube 3 is connected between the space 12 and the end cap 2, and a first passage 20 is defined in the end cap 2 and communicates with a space between the end cap 2 and the pushing member 22. The pushing member 22 is pushed by the spring 21 and the air pressurized coming from the first passage 20 so that the piston 25 is located at the ready-to-fire position as shown.

Referring to FIGS. 2 and 3, when the safety member 55 is pushed and the trigger 5 is pulled, the trigger valve 50 is moved to seal the hole 13 so that the pressurized air in the space between the end cap 2 and the pushing member 22 disappeared such that the pushing member 22 is pushed toward the end cap 2 and removed away from the end of the cylinder 241 by the pressurized air coming through slots 230 of a base 23 mounted to the cylinder 241. The pressurized air enters into the cylinder 241 to push the piston 25 from the gap resulted from the movement of the pushing member 22 so that a nail is ejected by the ejection plate connected to the piston 25. The air in the cylinder 241 is forced to be released into a space 100 between the cylinder 241 and the in side of the body of the gun via holes 240 defined through the cylinder 241.

Referring to FIG. 4, when releasing the trigger 5, the pressurized air reaches the space between the pushing member 22 and the end cap 2 again via the first passage 20 so that the pushing member 22 is pushed to seal the end of the cylinder 241 again by the force of the spring 21 and the pressurized air. The piston 25 is pushed back to its ready-to-fire position by the air in the space 100 via the holes 240 of the cylinder 241.

The size of the cylinder is limited by the diameter of the body of the gun and if larger nails are to be ejected, a bigger body of the gun is required to receive a larger cylinder, and this makes the whole nail gun to be bulky and heavy. Besides, the structure is so complicated and involves too many parts which are not convenient to be maintained.

The present invention intends to provide a pneumatic gun that guides the air to be released when pulling the trigger to push the piston back more quickly.

SUMMARY OF THE INVENTION

The present invention relates to a pneumatic nail gun and comprises a cylinder in a body of the gun and an end cap is fixed to connected a rear end of the body. A barrel is connected to a front of the body and a piston is movably received in the cylinder. An ejection plate is connected to the piston and movably inserted in the barrel.

A pushing member movably seals a first end of the cylinder and a spring is biased between the pushing member and the end cap. A second passage and a third passage are respectively defined through the end cap. The third passage communicates with a space defined between the cylinder and an inside of the body of the gun. An opening is defined in a second end of the cylinder and in communication with the space between the cylinder and the inside of the body of the gun and an interior of the cylinder.

A handle with a main passage is connected to the body and a trigger valve is received in a space in the handle. A hole is defined through the handle and communicates with the space and the main passage. A tube is located across the main passage and in communication with the second passage. A fourth passage is defined in the handle and communicates with the space.

The primary object of the present invention is to provide a pneumatic nail gun wherein the piston can be moved back to its ready-to-fire position quickly, and the gun allows a larger area piston operated in a compact body of the gun.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
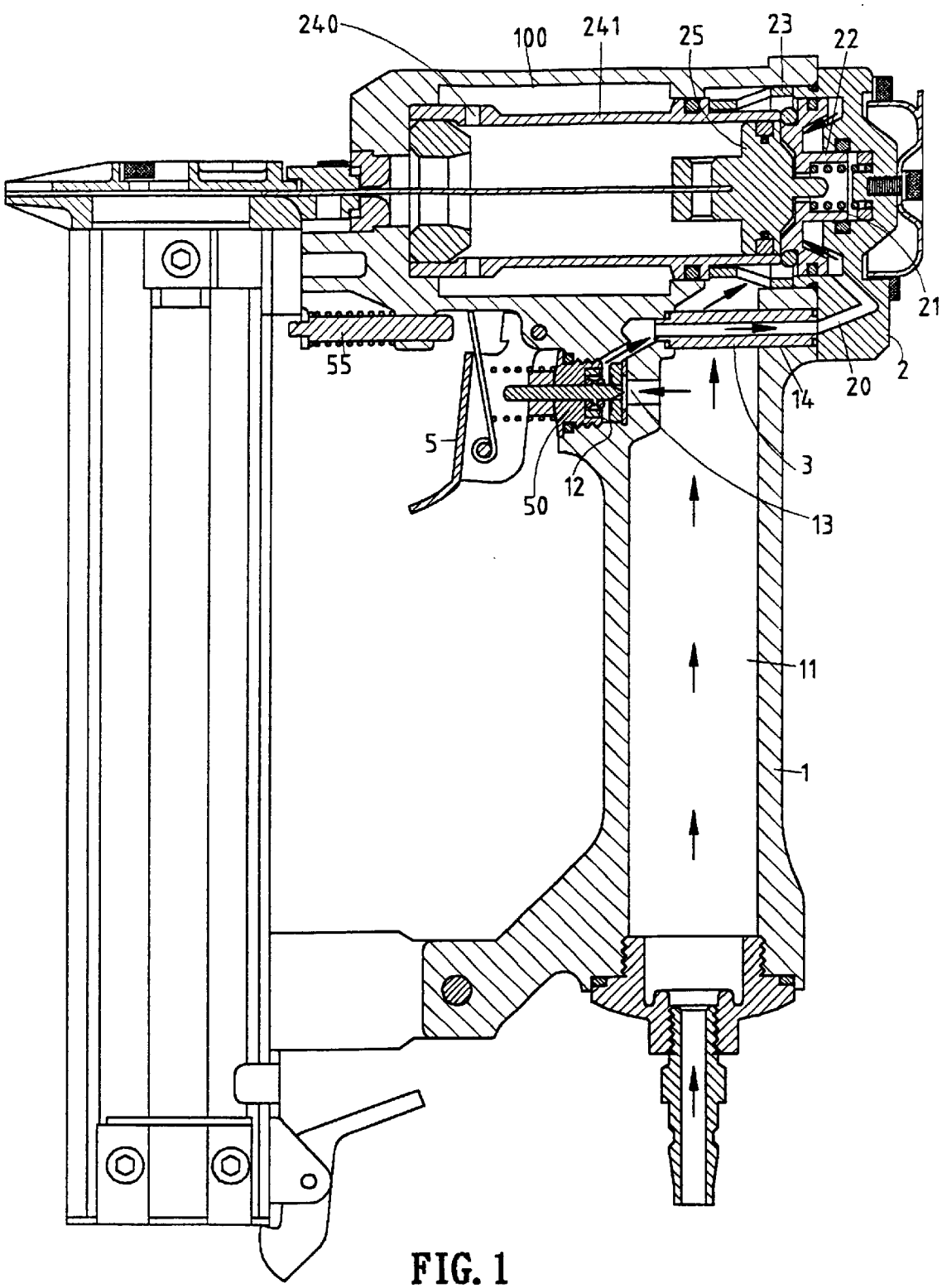
FIG. 1 PRIOR ART
FIG. 1 shows a conventional pneumatic nail gun wherein the trigger is not pulled.
Figure 2:
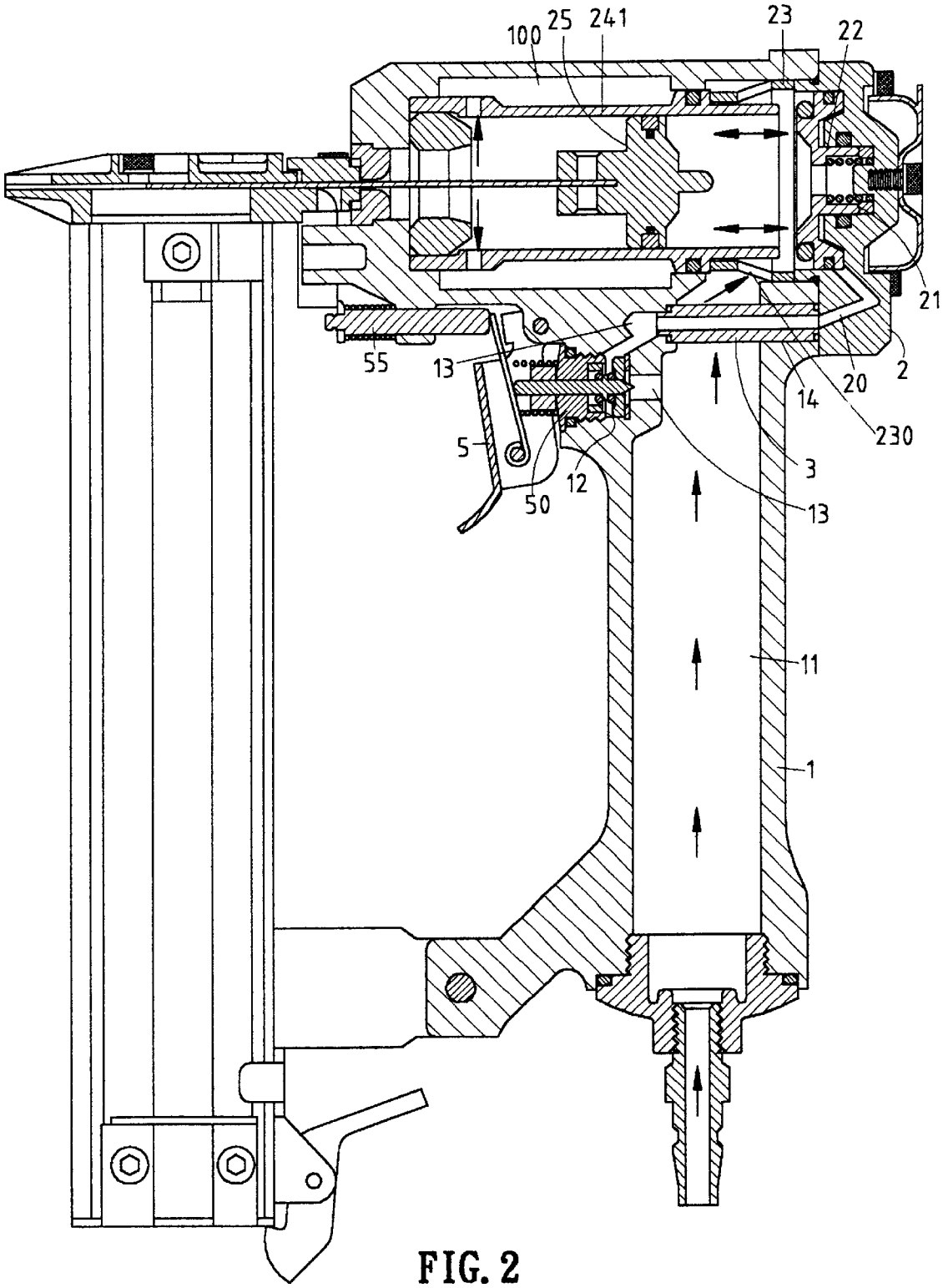
FIG. 2 PRIOR ART
FIGS. 2 and 3 show the safety member and the trigger of the conventional pneumatic nail gun are pulled.
Figure 3:
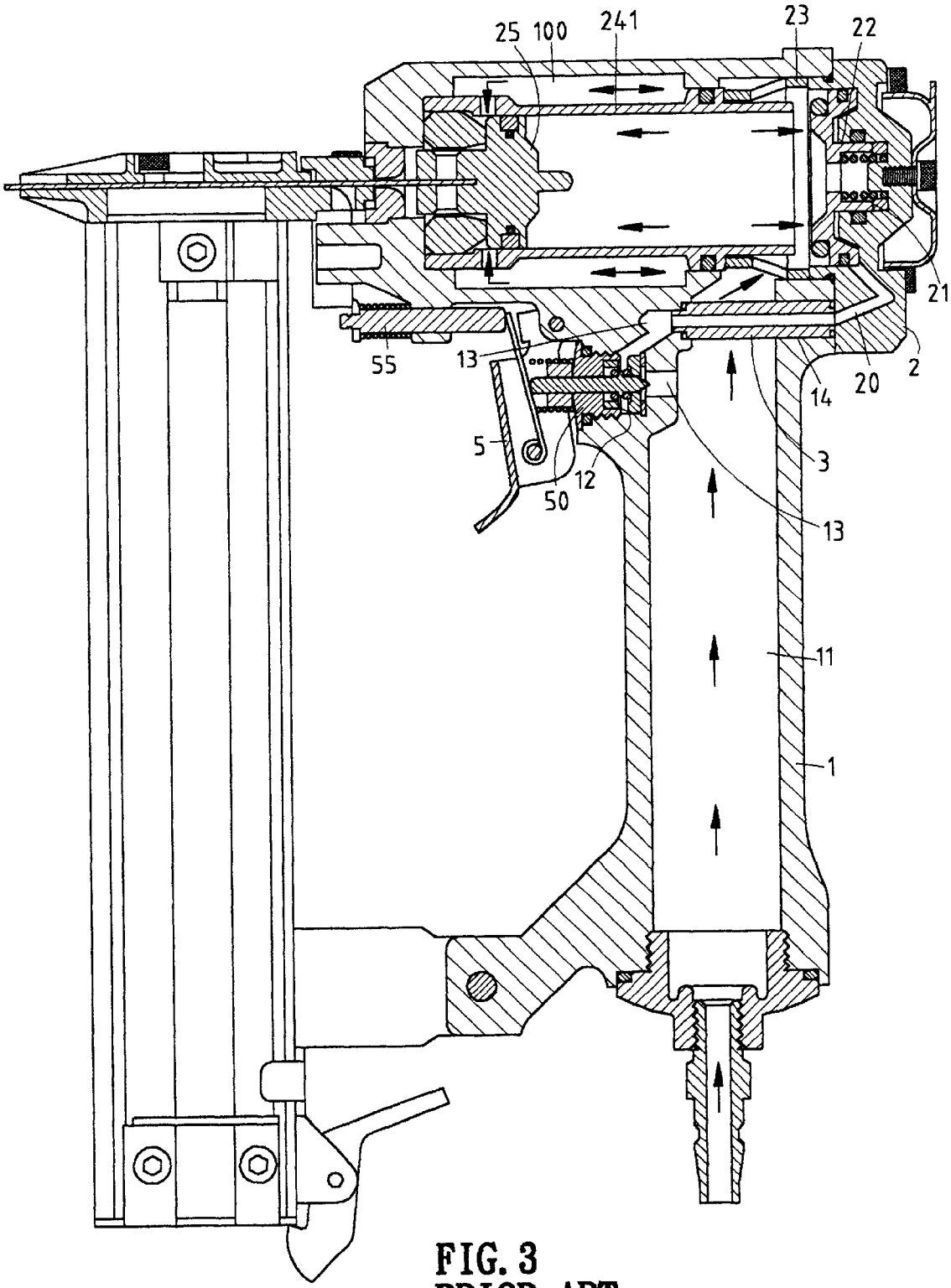
FIG. 3 PRIOR ART
Figure 4:
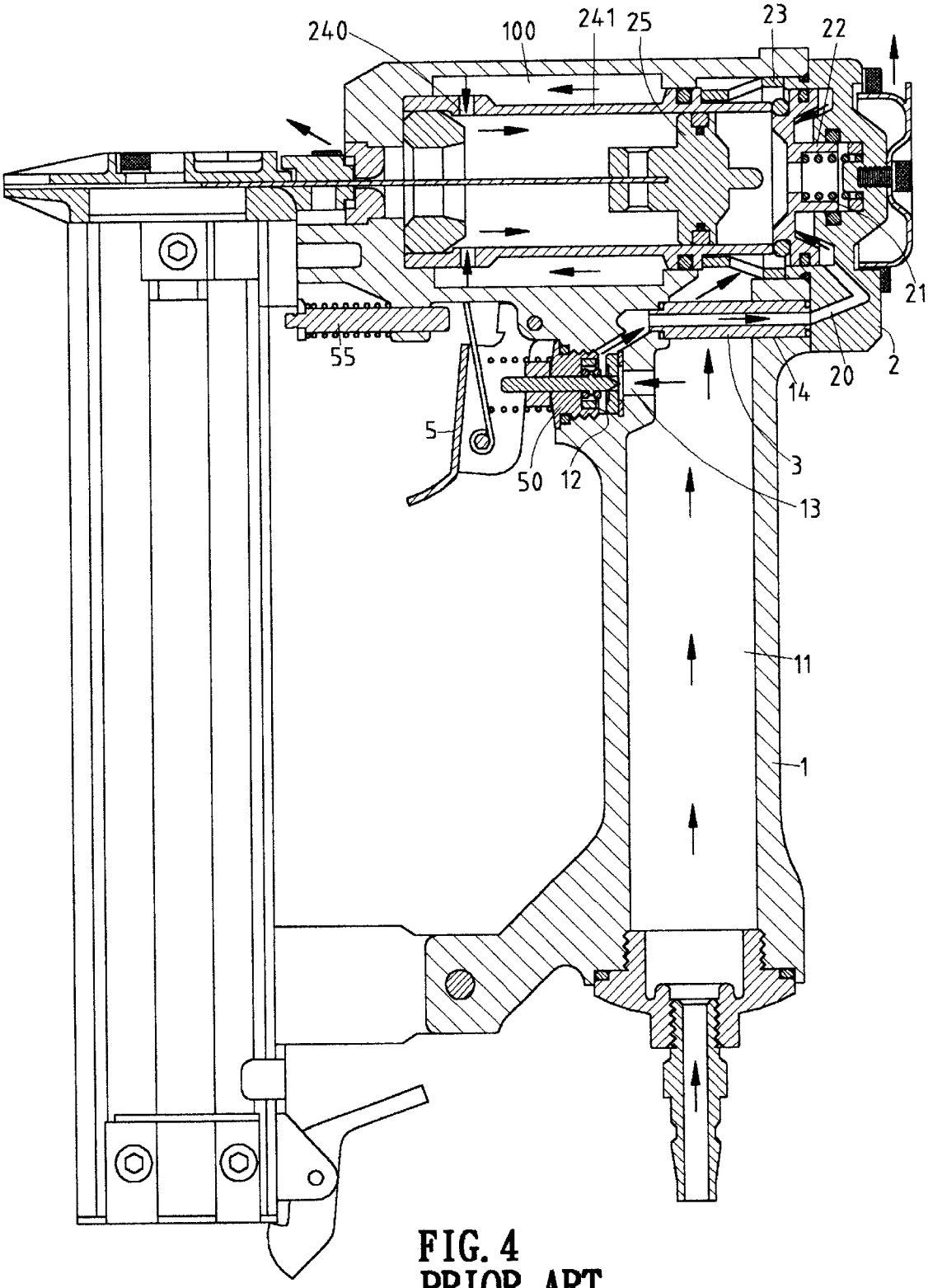
FIG. 4 PRIOR ART
FIG. 4 shows when the trigger of the conventional pneumatic nail gun is released.
Figure 5:
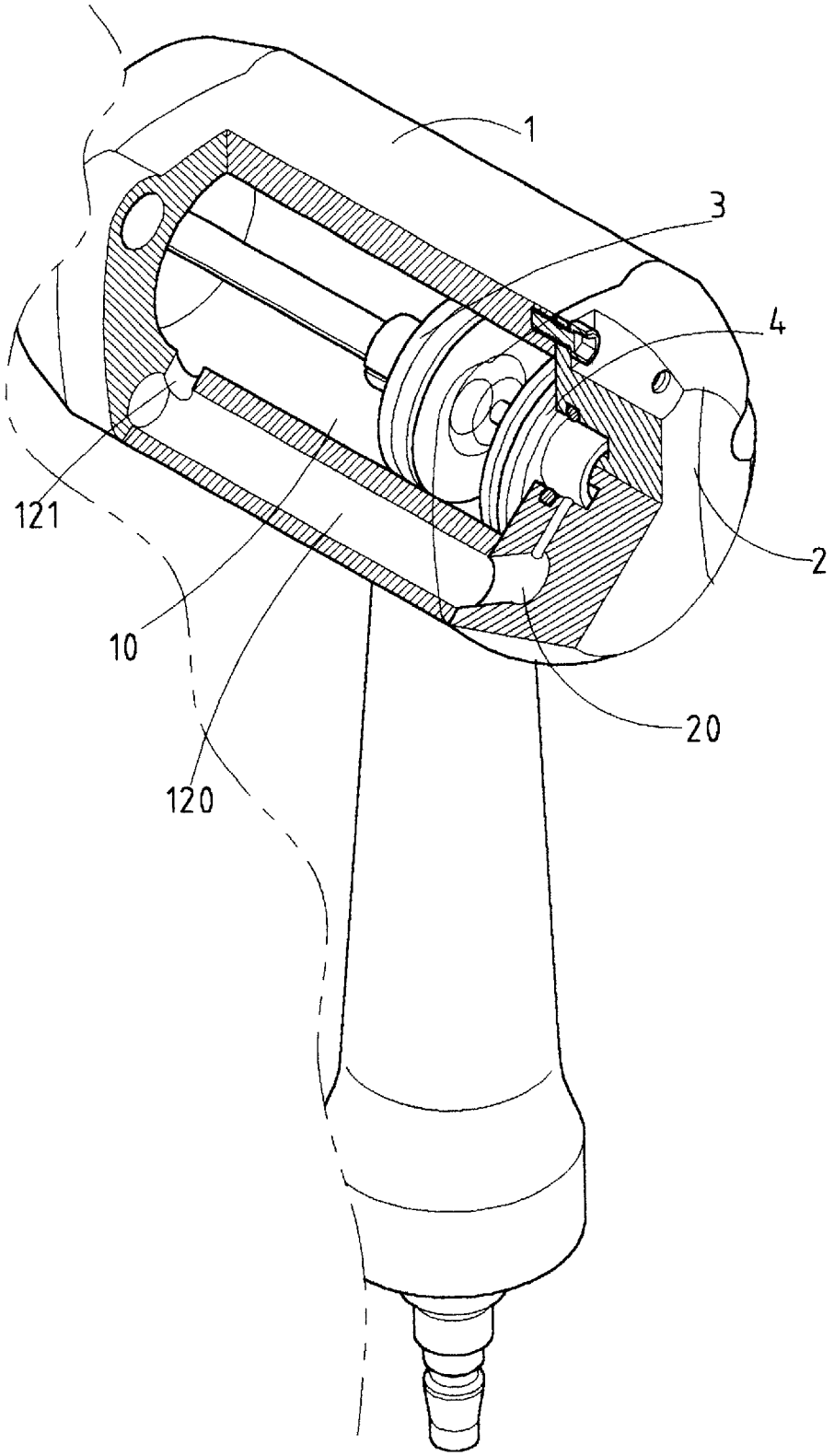
FIG. 5 shows an interior of the pneumatic nail gun of the present invention.
Figure 6:
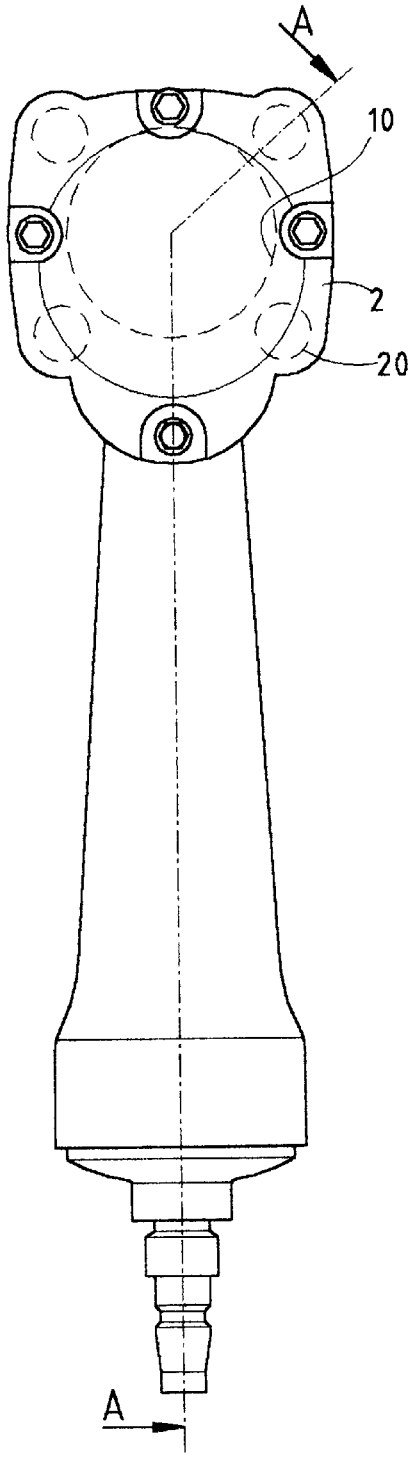
FIG. 6 is a rear end view to show the pneumatic nail gun of the present invention.
Figure 7:
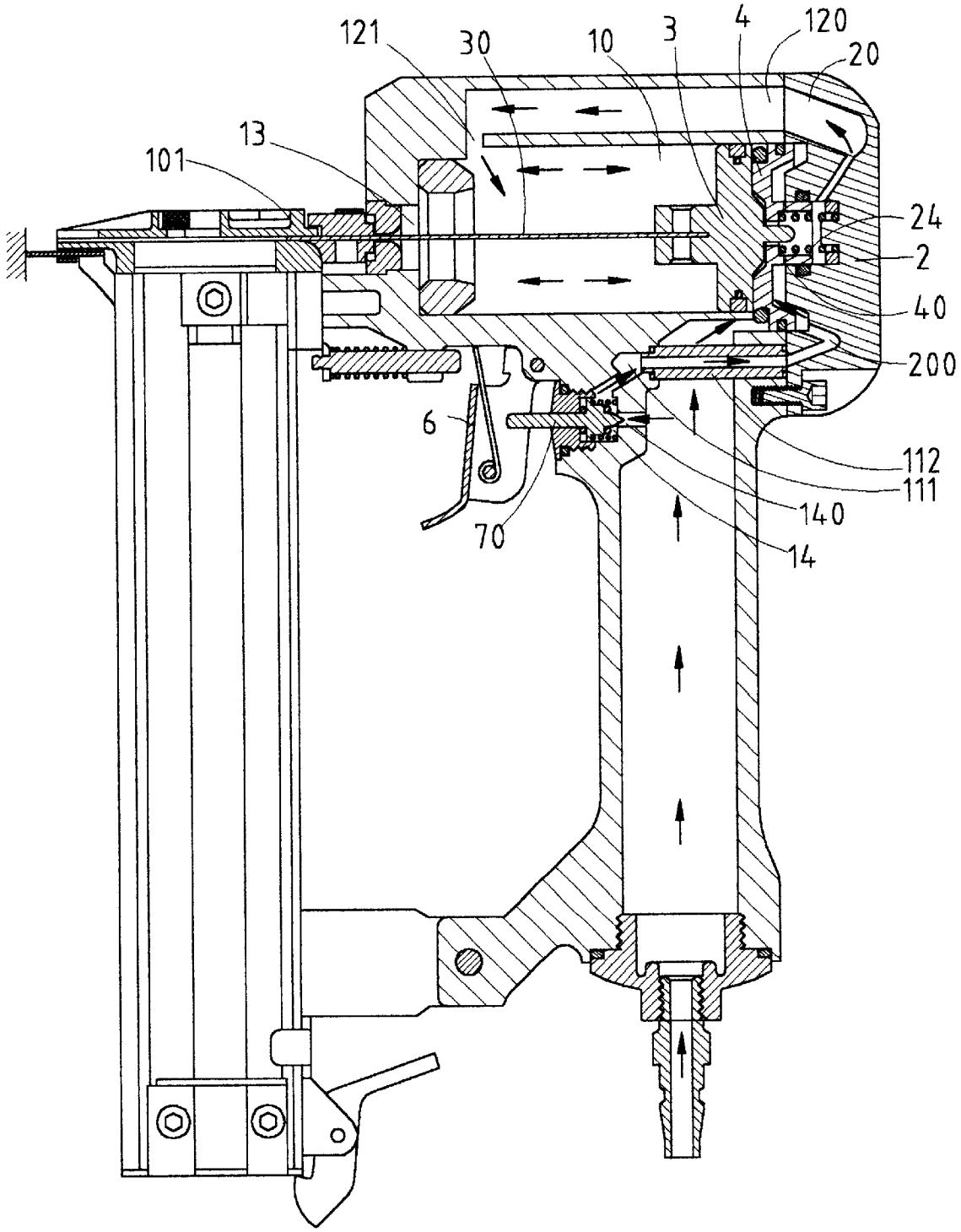
FIG. 7 shows the pneumatic nail gun of the present invention wherein the trigger is not pulled.

Referring to FIGS. 5 to 7, the pneumatic nail gun of the present invention comprises a cylinder 10 received in a body 1 of the gun and an end cap 2 is fixed to connected a rear end of the body 1. A barrel 101 is connected to a front of the body 1 and a piston 3 is movably received in the cylinder 10. An ejection plate 30 is connected to the piston 3 and movably inserted in the barrel 101. A magazine for receiving nails is connected to the barrel 101 and provides nails in the barrel 101 such that the nails are ejected by the ejection plate 30. A handle is connected to the body 1 of the gun and includes a main passage that is connected to a compressor so as to introduce pressurized air in the gun.

A pushing member 4 movably seals a first end of the cylinder 10 and a spring 24 is biased between the pushing member 4 and the end cap 2. A second passage 200 and a third passage 20 are respectively defined through the end cap 2. The third passage 20 communicates with a space 120 defined between the cylinder 10 and an inside of the body 1 of the gun. An opening 121 is defined in a second end of the cylinder 10 and in communication with the space 120 between the cylinder 10 and the inside of the body of the gun and an interior of the cylinder 10.

A space 14 is defined in the handle and a trigger valve 70 is received in the space 14. A hole 140 is defined through the handle and in communicating with the space 14 and the main passage in the handle. A tube 112 is located across the main passage and in communication with the second passage 200. A fourth passage 111 is defined in the handle and communicates with the space 14.

Figure 8:
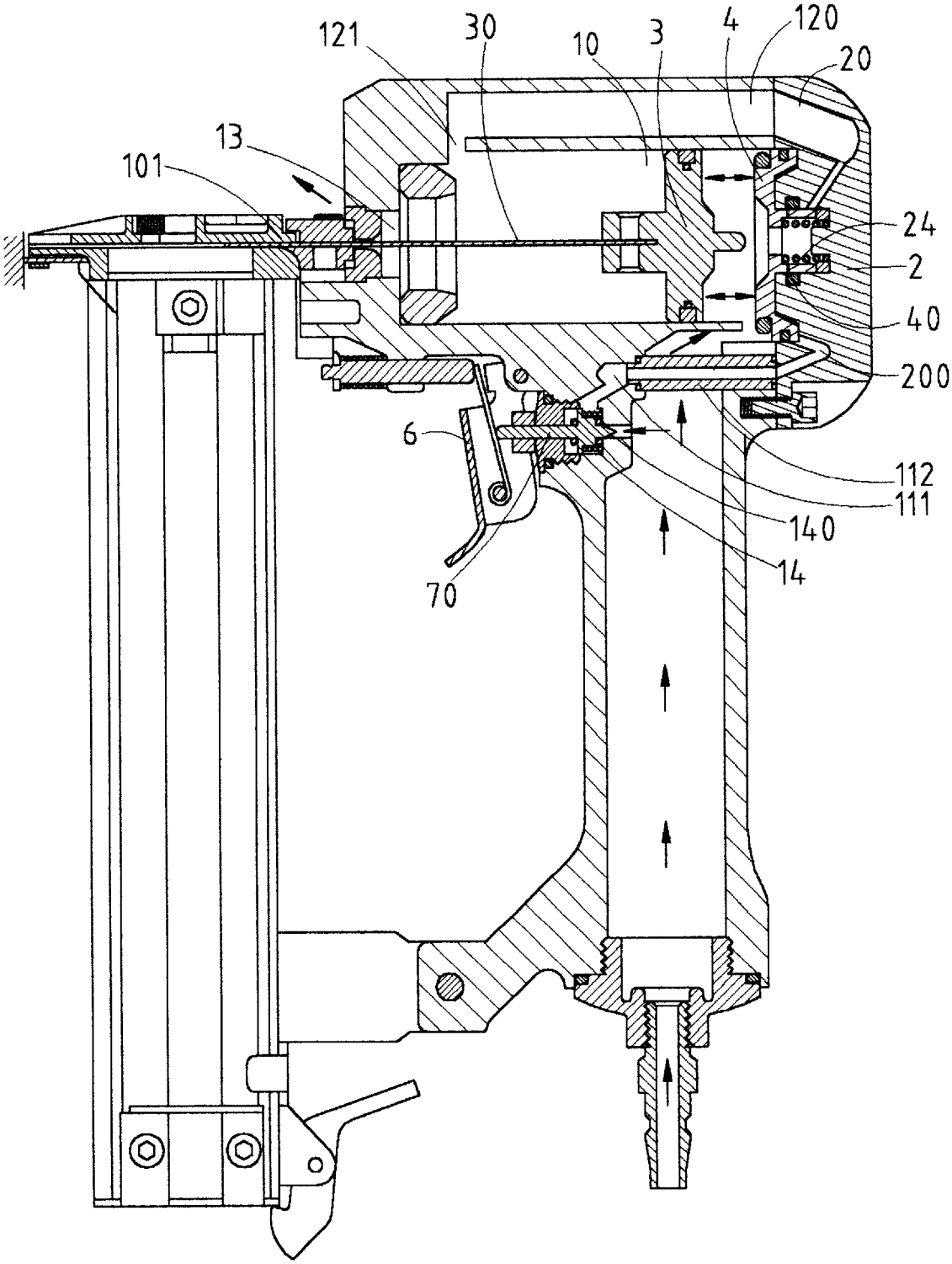
FIGS. 8 and 9 show the safety member and the trigger of the pneumatic nail gun of the present invention are pulled.
Figure 9:
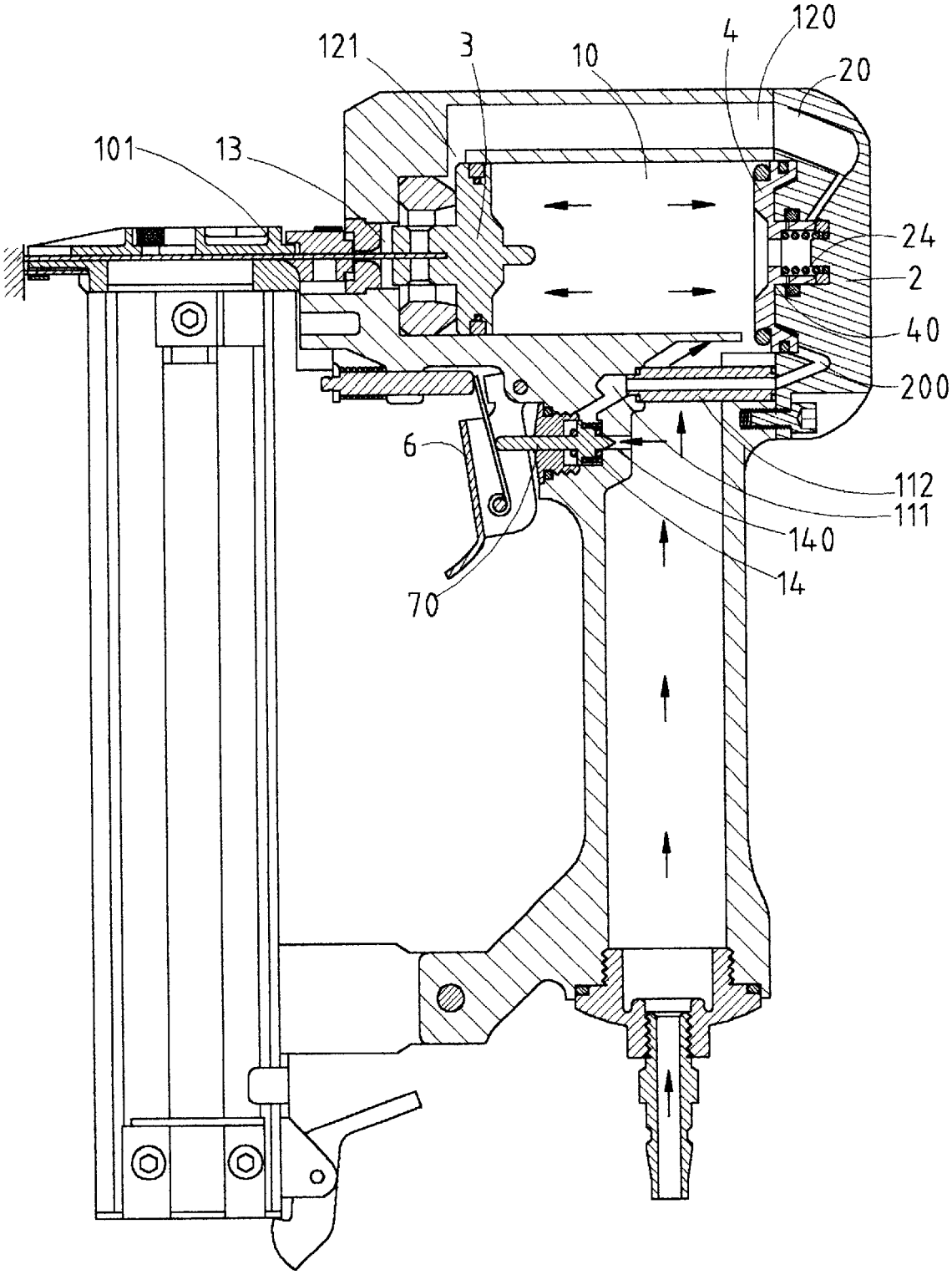

Referring to FIGS. 8 and 9, when a safety member located below the body 1 of the gun is pushed and a trigger 6 connected to the trigger valve 70 is pulled, the hole 140 is sealed by seal rings on the trigger valve 70 and the pressure in the space between the end cap 2 and the pushing member 4 is disappeared, the pushing member 4 is then pushed toward the end cap 2 by the pressurized air in the main passage and the pressurized air enters the interior of the cylinder 10 from the gap defined between the first end of the cylinder 10 and the pushing member 4. The piston 3 is then pushed to eject a nail.

Figure 10:
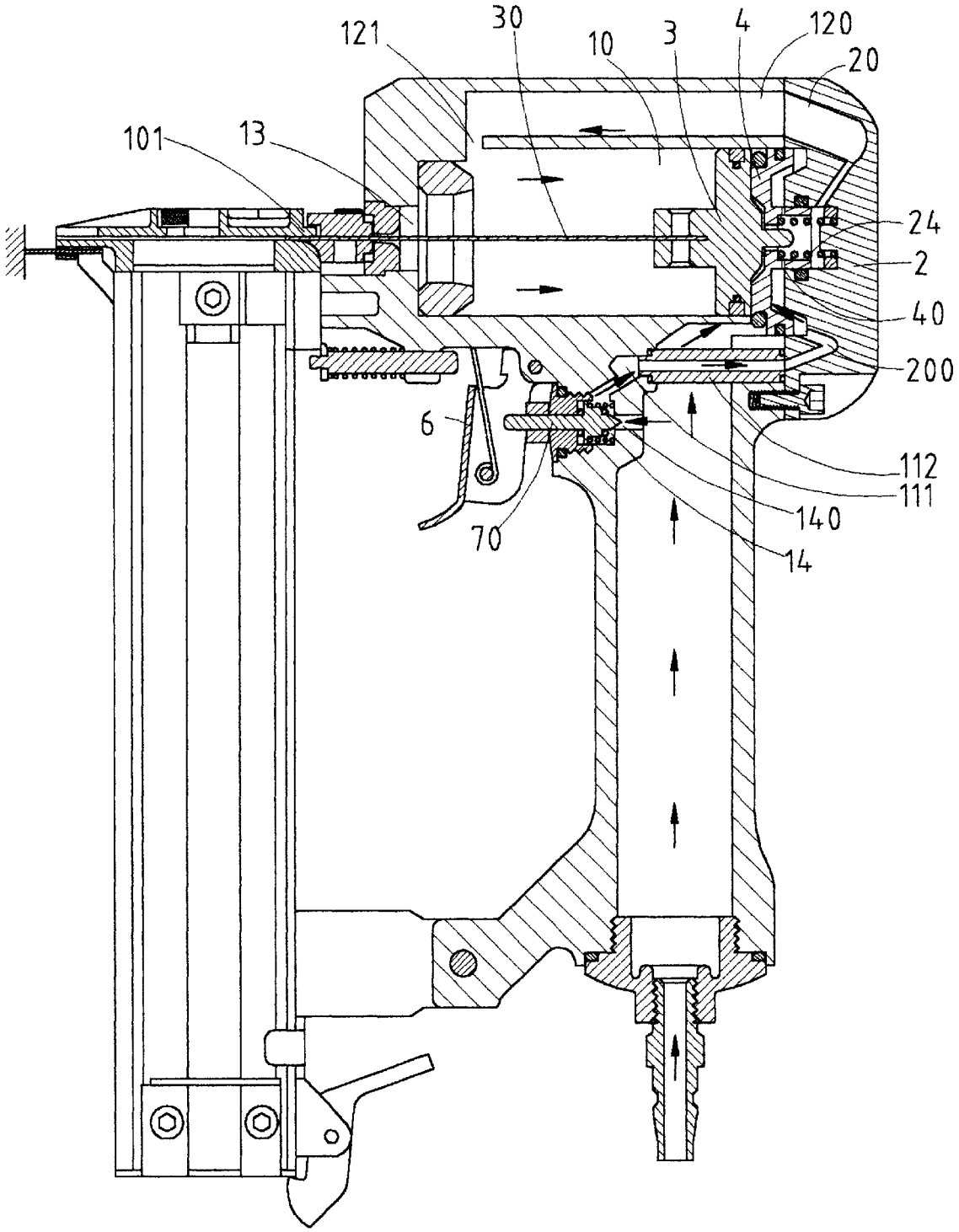
FIG. 10 shows the trigger is released after the nail is ejected.

Referring to FIG. 10, after ejecting the nail, the trigger 6 is released and the hole 140 is opened again. There is pressurized air in the space between the end cap 2 and the pushing member 4, and the pushing member 4 is pushed again to seal the first end of the cylinder 10. When the piston 3 goes back to its ready-to-fire position, the air in the cylinder 10 goes through the third passage 20 and enters into the cylinder 10 via the opening 121 to quickly push the piston 3 back. The air being forced out from the cylinder 10 when the piston 3 is going back to its ready-to-fire position is guided to accelerate the movement of the piston 3.

Figure 11:
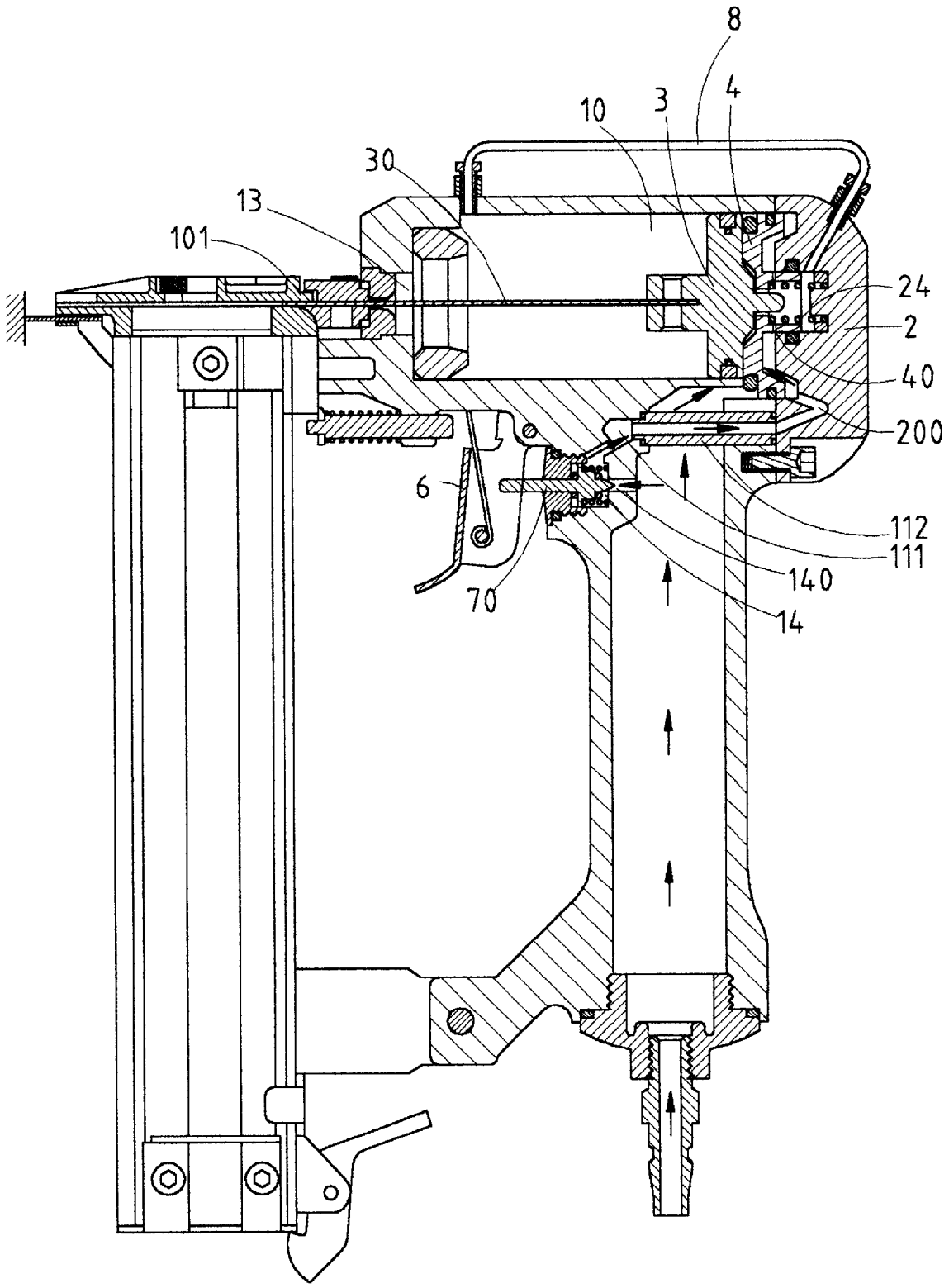
FIG. 11 shows another embodiment of the pneumatic nail gun of the present invention.

FIG. 11 shows another embodiment of the present invention wherein the nail gun has a hollow body and a piston 3 is movably received in the hollow body so that the area of the piston 3 can be made to its maximum value for the nail gun.

A pipe 8 is connected between the end cap 2 and the exterior of the hollow body. A second passage 200 and a third passage 20 respectively defined through the end cap 2 on a rear end of the hollow body. A first end of the pipe 8 communicates with the third passage 20 and a second end of the pipe 8 communicates with an interior of hollow body. The third passage 20 communicates with the interior of the hollow body and a space between the end cap 2 and the pushing member 4. The space between the cylinder and the inside of the body in FIG. 7 is replaced with the pipe 8, so that the piston 3 can be a larger one without changing the size of the body.

Figure 12:
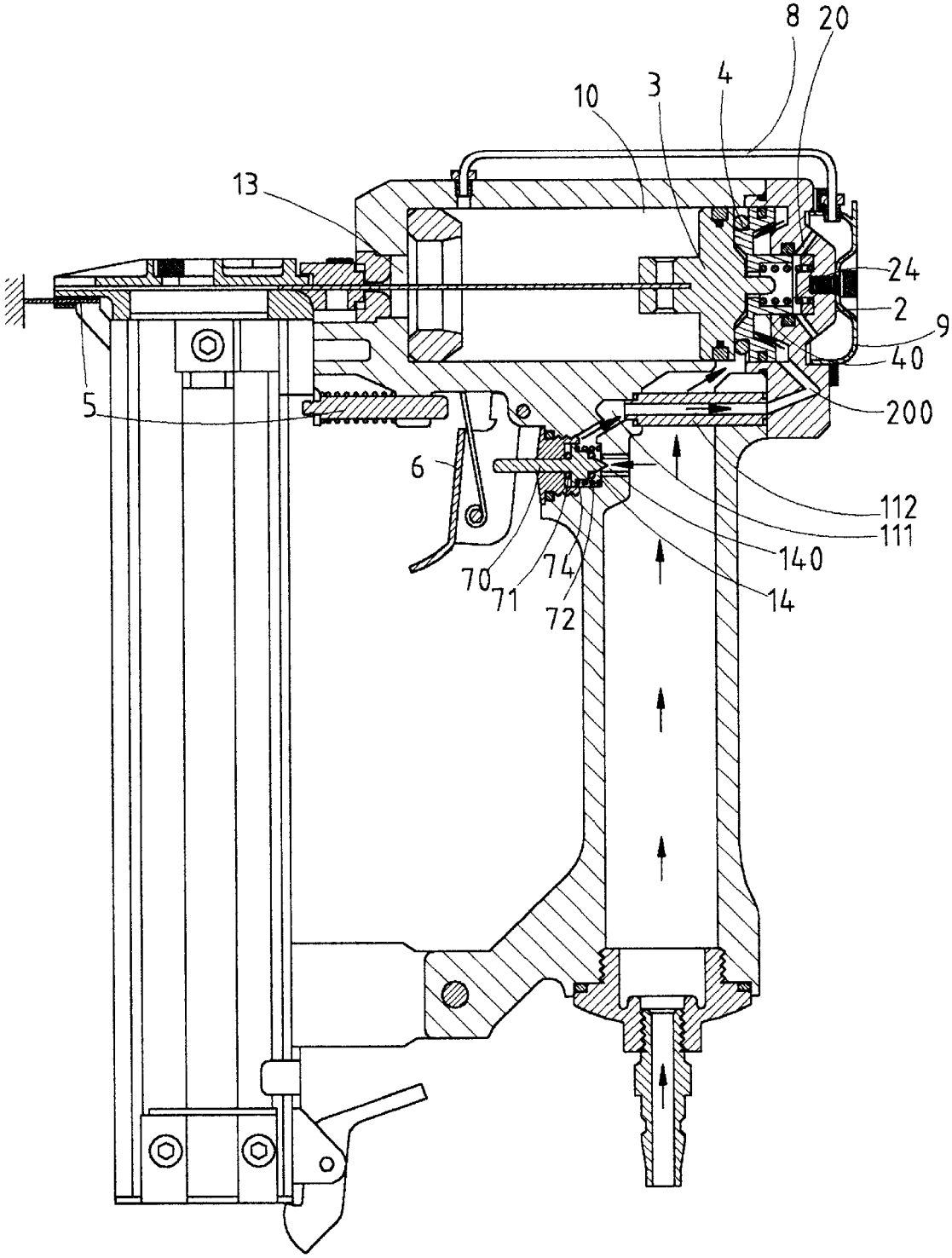
FIG. 12 shows yet another embodiment of the pneumatic nail gun of the present invention.

FIG. 12 shows yet another embodiment of the pneumatic nail gun of the present invention, wherein the end cap 2 has a chamber 9 which communicates with the third passage 20 and the first end of the pipe 8. The volume of the chamber 9 keeps the air being forced out from the interior of the hollow body so as to be used to push the piston back.

While we have shown and described the embodiment in accordance with the present invention, it should be clear to those skilled in the art that further embodiments may be made without departing from the scope of the present invention.

What is claimed is:

1. A pneumatic nail gun comprising:

a cylinder (10) received in a body (1) of the gun and an end cap (2) fixed to connected a rear end of the body (1), a barrel (101) connected to a front of the body (1) and a piston (3) movably received in the cylinder (10), an ejection plate (30) connected to the piston (3) and movably inserted in the barrel (101);

a pushing member (4) movably sealing a first end of the cylinder (10) and a spring (24) biased between the pushing member (4) and the end cap (2), a second passage (200) and a third passage (20) respectively defined through the end cap (2), the third passage (20) communicating with a space (120) defined between the cylinder (10) and an inside of the body (1) of the gun, an opening (121) defined in a second end of the cylinder (10) and in communication with the space (120) between the cylinder (10) and the inside of the body (1) of the gun and an interior of the cylinder (10), and a handle connected to the body (1) and having a space (14) and a trigger valve (70) receiving in the space (14), a hole (140) defined through the handle and communicating with the space (14), a main passage defined through the handle and communicating with the hole (140), a tube (112) located across the main passage and in communication with the second passage (200) and a fourth passage (111) defined in the handle and communicating with the space (14).

2. A pneumatic nail gun comprising:

a hollow body and an end cap (2) fixed to connected a rear end of the body, a barrel (101) connected to a front of the body and a piston (3) movably received in the hollow body, an ejection plate (30) connected to the piston (3) and movably inserted in the barrel (101), a pushing member (4) movably sealing a first end of the cylinder (10) and a spring (24) biased between the pushing member (4) and the end cap (2), a pipe (8) connected between the end cap (2) and the hollow body, a second passage (200) and a third passage (20) respectively defined through the end cap (2), a first end of the pipe (8) communicating with the third passage (20) and a second end of the pipe (8) communicating with an interior of hollow body, the third passage (20) communicating with the interior of the hollow body and a space between the end cap (2) and the pushing member (4), and a handle connected to the body and having a space (14) and a trigger valve (70) receiving in the space (14), a hole (140) defined through the handle and communicating with the space (14), a main passage defined through the handle and communicating with the hole (140), a tube (112) located across the main passage and in communication with the second passage (200) and a fourth passage (111) defined in the handle and communicating with the space (14).

3. The nail gun as claimed in claim 2, wherein the end cap (2) has a chamber (9) which communicates with the third passage (20) and the first end of the pipe (8).

* * * * *